United States Patent [19]

Bedell et al.

[11] Patent Number: 4,756,788

[45] Date of Patent: Jul. 12, 1988

[54] INLINE WINDER WITH TAKE-UP WEB

[75] Inventors: John R. Bedell, Madison; Naim S. Hemmat, Mendham; Paul Jeges, Blairstown, all of N.J.

[73] Assignee: Allied-Signal Inc., Morris Township, Morris County, N.J.

[21] Appl. No.: 929,465

[22] Filed: Nov. 12, 1986

Related U.S. Application Data

[62] Division of Ser. No. 695,148, Jan. 25, 1985, Pat. No. 4,644,999.

[51] Int. Cl.[4] ..... B22D 11/06; B22D 11/08

[52] U.S. Cl. ..... 156/382; 156/242; 156/246; 156/501; 164/463; 164/474; 164/479; 164/483; 242/25 R; 242/47

[58] Field of Search ..... 156/242, 246, 382, 501; 164/423, 429, 463, 474, 479, 483; 242/25 R, 47, 55; 226/96, 97

[56] References Cited

U.S. PATENT DOCUMENTS

| | | | |
|---|---|---|---|
| 2,350,987 | 6/1944 | Collins | 156/246 |
| 2,690,206 | 9/1954 | Mueller | 156/501 |
| 2,744,044 | 5/1956 | Toulman | 156/242 |
| 3,518,148 | 6/1970 | Jacobson | 156/246 |
| 3,526,000 | 8/1970 | Williams | 156/324 |
| 3,862,658 | 1/1975 | Bedell | 164/463 |
| 4,116,394 | 9/1978 | Smith et al. | 242/25 |
| 4,142,571 | 3/1979 | Narasimhem | 164/429 |
| 4,202,404 | 5/1980 | Carlson | 164/423 |
| 4,239,187 | 12/1980 | Boggs et al. | 242/25 R |
| 4,316,497 | 2/1982 | Wakefield et al. | 164/483 |
| 4,450,997 | 5/1984 | Li | 226/97 |
| 4,470,553 | 9/1984 | Boggs et al. | 242/25 R |
| 4,559,992 | 12/1985 | Bedell et al. | 164/474 |
| 4,592,411 | 6/1986 | Bedell et al. | 164/474 |

*Primary Examiner*—Caleb Weston

*Attorney, Agent, or Firm*—Gus T. Hampilos; Ernest D. Buff

[57] ABSTRACT

The present invention provides a method and apparatus for taking up and winding a strip of material which is advancing at a selected velocity from a moving casting surface. Generally stated, the apparatus includes a take-up web supply mechanism for supplying a flexible, take-up web, and a winding mechanism, which has a reel for taking up and concentrically winding the strip and take-up web thereon in a laminated configuration. A connection mechanism connects the take-up web to the reel, and a reel drive mechanism rotates the reel to provide a peripheral velocity at a winding surface on the reel that substantially matches the velocity of the advancing strip. A directing mechanism directs the advancing strip onto the take-up web for transport to a winder nip region between the take-up web and the winding surface of the reel means to initiate winding.

13 Claims, 6 Drawing Sheets

INLINE WINDER WITH TAKE-UP WEB

This application is a division of application Ser. No. 695,148 filed Jan. 25, 1985, now U.S. Pat. No. 4,644,999.

FIELD OF THE INVENTION

The present invention relates to the winding of an advancing strip onto a rotating winding reel. More particularly, the invention relates to the winding of a rapidly cast metal strip onto an inline winding reel.

BACKGROUND OF THE INVENTION

U.S. Pat. No. 4,470,553 to Boggs, et al. discloses an inline winder which includes a synchronous hysteresis motor. U.S. Pat. No. 4,239,187 to Boggs, et al. discloses a filament string-up device which includes two counter-rotating brush rollers which capture an advancing filament in the nip region therebetween. U.S. Pat. No. 4,116,394 to Smith, et al. discloses a cut and grab mechanism employed to grip a rapidly cast metal strip onto an already rotating winding reel. U.S. Pat. No. 4,142,571 to Narasiman discloses a method and apparatus for continuously casting rapidly solidified strip. U.S. Pat. No. 4,450,997 to Li, et al. discloses an aspirator type string-up device which employs gas jets to capture moving filament between two movable plate sections. U.S. Pat. No. 3,862,658 to Bedell and U.S. Pat. No. 4,202,404 to Carlson disclose endless belts employed to press a cast strip against the quenching surface of a rotable casting wheel.

Conventional high speed inline winders typically operate at a distance from the strip casting machines. As a result, a considerable quantity of strip is lost as scrap before a winder can catch, traverse, string-up, cut and grab the strip to begin winding. This type of winding is undesirable when the cast strip contains precious elements, such as gold, silver, platinum, palladium and the like; when the volume of material being cast is small; and when the strip is not strong enough to withstand the stresses incurred during the string-up or the cut and grab operations. In addition, conventional winders can only take-up and wind a single strip. When simultaneously casting multiple strips on a single casting surface, the cast strips become entangled if they are wound on a single, inline winder reel employing conventional techniques.

SUMMARY OF THE INVENTION

The present invention provides a method and apparatus for taking up and winding a strip of material which is advancing at a selected velocity from a moving casting surface. Generally stated, the apparatus includes a take-up web supply means for supplying a flexible, take-up web, and a winding means, which has reel means for taking up and concentrically winding the strip and take-up web thereon in a laminated configuration. Connection means connect the take-up web to the reel at a selected time, and reel drive means rotate the reel to provide a peripheral, tangential velocity at a winding surface on the reel that substantially matches the linear velocity of the advancing strip. Directing means direct the advancing strip onto the take-up web for transport to a winder nip region located at the winding surface of the reel means.

The invention further provides a method for taking up and winding a strip of material, which is advancing at a predetermined velocity from a moving casting surface. The method includes the steps of supplying a flexible take-up web, and connecting the take-up web to a peripheral winding surface on a winding reel. The reel is rotated to provide a peripheral velocity at the winding surface which substantially equals the velocity of the advancing strip. The advancing strip is contacted with the take-up web to move the strip along with the take-up web onto the reel. The strip and take-up web are concentrically wound onto the reel to form alternating, laminated layers.

The method and apparatus of the invention advantageously minimize the time between the initiation of strip casting and the time of string-up of the strip onto a winding reel. This minimizes the amount of scrap strip produced and provides a supporting web for the strip which absorbs the stresses ordinarily incurred during the attachment of the strip to the winding reel. As a result, the method and apparatus of the invention efficiently and reliably capture and string-up rapidly cast strip onto a rotating winding reel with a minimum of scrap and a minimum loss of expensive strip material.

The present invention also allows the simultaneous casting of multiple, parallel strips on a single chilled surface and the simultaneously winding of the strips in parallel arrangement on a single winding reel. The wound strips are substantially free from damage or entanglements.

In addition, the invention permits the winding of strip at locations remote from the casting location and makes it possible to continuously vacuum cast strip while simultaneously and continuously extracting the strip from the vacuum chamber to an inline winder located in the ambient atmosphere. Similarly, the present invention allows the casting of strip in a chamber containing a preselected atmosphere, such as an inert atmosphere or a reducing atmosphere, and then continuously removing the cast strip from the chamber for concurrent winding in the ambient atmosphere.

BRIEF DESCRIPTION OF THE DRAWINGS

The invention will be more fully understood and further advantages will become apparent when reference is made to the following detailed description of the preferred embodiment of the invention and the accompanying drawings in which.

DETAILED DESCRIPTION OF THE DRAWINGS

The present invention is described below in the context of casting rapidly solidified metal strip. However, it is readily apparent that the method and apparatus of the present invention can also be employed to take up and wind other types of filamentary or strip material, such as those composed of fibers or plastics, all of which are contemplated as being within the scope of the present invention.

For the purposes of the present invention, a strip is an elongated solid body, the transverse width and thickness dimensions of which are much smaller than its length.

Figure 1:
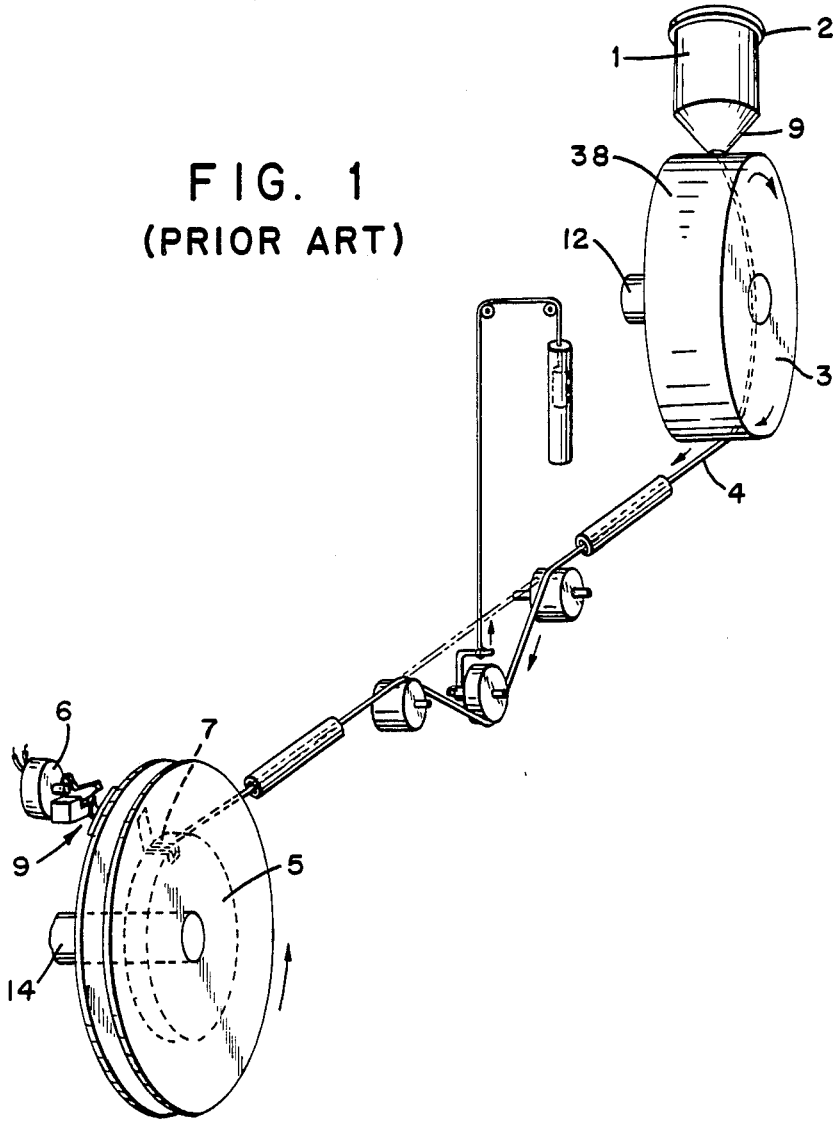
FIG. 1 (PRIOR ART)
FIG. 1 shows a schematic representation of a prior art casting apparatus and prior art cut and grab mechanism associated with a winding reel.

FIG. 1 representatively shows a prior art apparatus for casting rapidly solidified strip. Molten alloy contained in crucible 1 is heated by a heating element 2. Pressurization of the crucible with an inert gas extrudes a molten stream through nozzle 9 located at the base of the crucible onto a rotating quench wheel 3. Solidified, moving strip 4, after its breakaway point from the quench reel is routed onto a winding reel 5, which may be provided with a torque controller (not shown) to regulate the winding tension exerted on the strip. A grip element 7 then secures the filament to reel 5.

Strip string-up begins by capturing an advancing portion of the strip in a string-up means, such as an aspirator device. The string-up means moves to contact the advancing strip with the winding surface of the winding reel, rotating at a speed approximately matching that of the advancing strip. A trigger device 6, such as a photoelectric sensor and solenoid, then releases a spring loaded, pivotable gripping element 7 associated with the winding reel to cut and secure the advancing strip 4 to reel 5, whereupon winding proceeds inline with the casting process. A representative example of such a cut and grip apparatus is shown in U.S. Pat. No. 4,116,394 to R. Smith, et al., which is hereby incorporated by reference thereto.

Winder string-up of an advancing strip in the above described manner is especially difficult and tedious due to the high speed of the strip, typically up to 2,200 meters per minute. Rapidly solidified strip is spun at this high speed to achieve the extremely rapid quench rates required to produce the desired alloy structures and physical properties. A suitable method and apparatus for producing rapidly solidified metal strip is disclosed in U.S. Pat. No. 4,142,571 to Narasimhan, which is hereby incorporated by reference thereto.

Figure 2A:
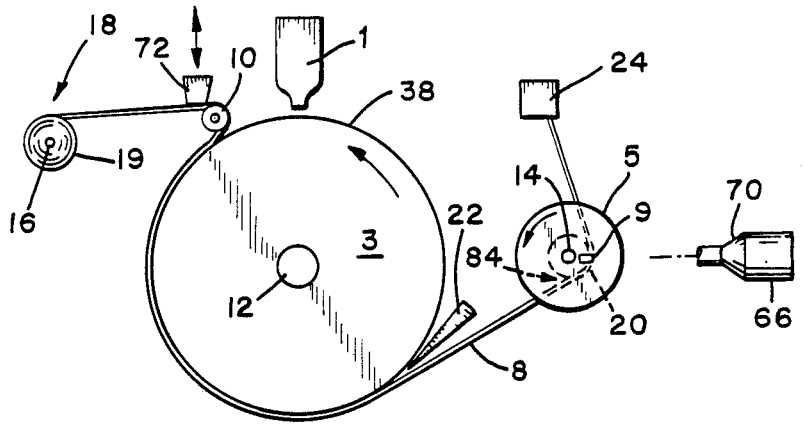
FIG. 2*a* shows a schematic representation of a take-up web employed to capture and string-up a cast strip onto a winding reel.
Figure 2B:
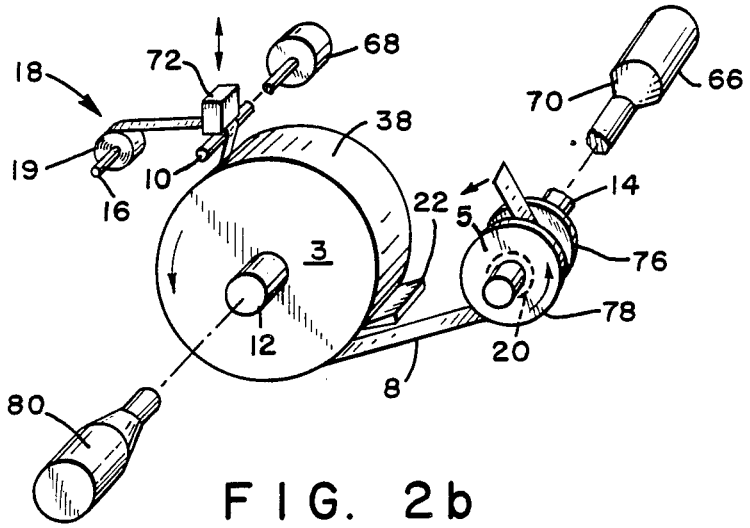
FIG. 2*b* shows a perspective view of the apparatus shown in FIG. 2*a*.
Figure 3:
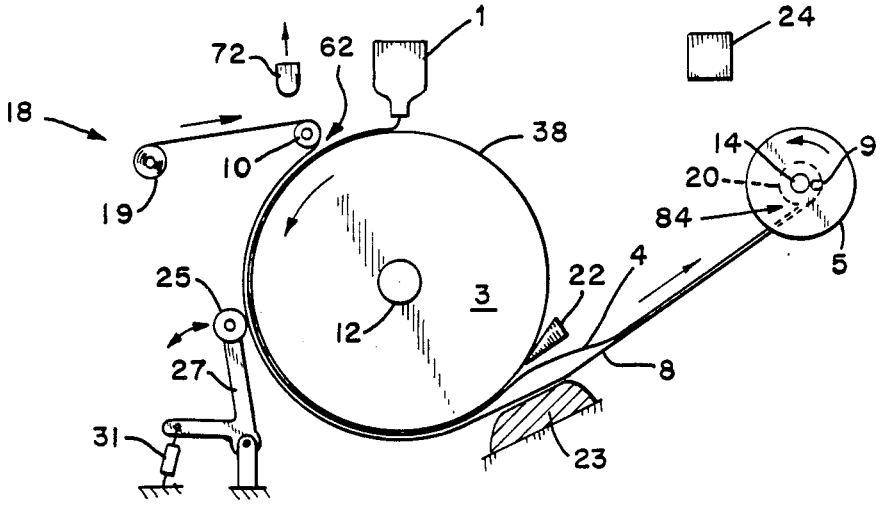
FIG. 3 shows a schematic representation of a take-up web which during casting has directed a cast strip onto a winding reel.

FIGS. 2*a* and 2*b* representatvely show a particular, preferred embodiment of the apparatus for taking up and winding a strip of material which is advancing at a selected velocity from a moving casting surface. Take-up web supply means 18 supplies a flexible take-up web 8, and a winding means has a reel 5 for taking up and concentrically winding strip 4 and take-up web 8 thereon in a laminated configuration (FIG. 3). A connecting means, such as grab mechanism 9, connects the take-up web to the reel, and a reel drive means, such as motor 66, rotates the reel to provide a peripheral velocity at winding surface 20 on reel 5 that substantially matches the velocity of the advancing strip 4. Directing means, such as guide roller 10 and stripper device 22, direct the advancing strip onto web 8 for transport to a winder nip region 84 located between take-up web 8 and winding surface 20 of reel 5.

Figure 8:
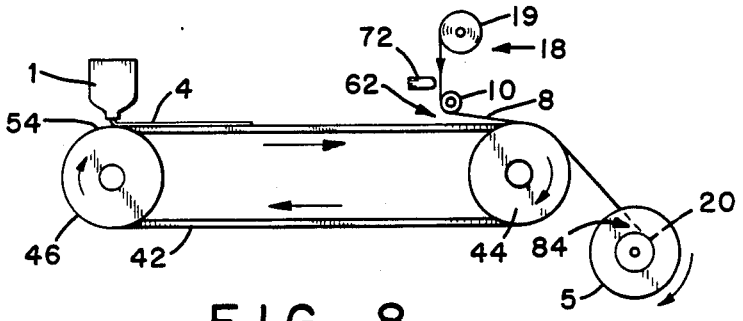
FIG. 8 shows a schematic representation of a take-up web employed to direct cast filament from a endless casting belt.

Casting guench surface 38 can be provided by the outer, peripheral surface of a chilled casting wheel 3 representatively shown in FIG. 2*a*, or by the surface of a movable, endless casting belt 42 representatively shown in FIG. 8. In either case, quench surface 38 should be constructed from a material having high thermal conductivity, such as steel or beryllium-copper.

Referring again to FIGS. 2*a* and 2*b*, casting wheel 3 is an annular chill roll rotatable about axis 12 and driven by a drive means, such as drive motor 80. A take-up web supply means 18 includes a roll, spool or bobbin 19 filled with a thin, flexible web material, such as paper, Mylar, plastic sheet or metal foil. The web roll 19 rotates about axis 16.

Figure 2C:
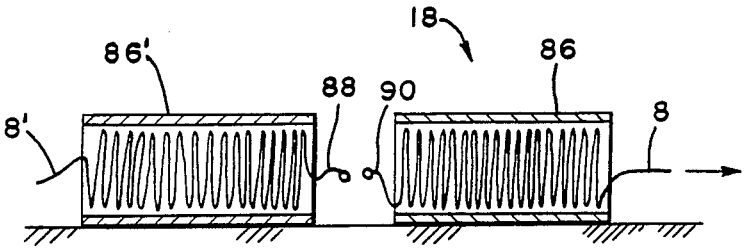
FIG. 2*c* representatively shows a stuffer box containing a nested web supply comprised of a plurality of interconnected layers of web material.

Alternatively, the take-up web supply is comprised of a stuffer box 86 which contains a plurality of layers of web material connected at alternating end portions thereof to form a configuration of zig-zag folds nested into a horizontal or vertical stick. This "accordian" type arrangement of web layers is representatively shown in FIG. 2*c*. By employing such nested web material, there is less inertia to overcome when first accelerating the speed of the web to match the speed of the cast strip. In addition, one can more readily replenish the supply of web material without interrupting the casting operation because the end of the web supply is easily accessible. One simply attaches the leading end 88 of a new supply of nested, web material to the terminal end 90 of the previous supply. The ability to replenish the web supply particularly is important when one desires to laminate the entire length of cast strip with the web material. In particular, when simultaneously casting multiple strips on a single quenching surface, the use of a substantially continuous web laminated along the length of the cast strips minimizes entanglements between the individual strips as the strips are wound on a single, inline winder reel. The web allows the formation of a single wound package comprised of multiple strips wound in a separated, parallel configuration.

Winding reel 5, which is rotatable about shaft 14, includes a concentric winding surface 20 located on a hub-core portion thereof, and includes two radially extending flange members 78 and 76 which constrain the wound strip package there between.

Grab mechanism 9, along with optional holding mechanism 24, provides a representative connection means for connecting web 8 to winding surface 20 of winding reel 5. A reel drive means for rotating reel 5 includes an electric motor 66 connected to rotably driven reel 5 by means of shaft 14. Motor 66 may optionally include a tensioning mechanism 70 to control the tension applied to web 8 and cast strip 4. For example, the motor may be a synchronous hysteresis motor connected to drive a winding reel as disclosed in U.S. Pat. No. 4,470,553 to B. Boggs. Alternatively, a conventional electromechanical torque-brake motor may be employed to regulate the rotation of a drum (not shown), which contacts strip 4 and web 8 and applies tension thereto.

Web 8 is drawn from web supply roll 19, passed over guide roller 10, and wrapped around stationary, non-rotating casting wheel 3. Take-up web 8 then passes onto stationary winding reel 5 and is held in contact with winding surface 20 with optional holding means 24. Web 8 is thereby placed in a hugging relation with casting surface 38 with one side of web 8 in facing contact with chill surface 38. A braking means, such as brake member 72, contacts take-up web 8 and presses against guide roller 10 to prevent movement of the web. Chill wheel 3 is spun up to a desired casting speed by motor 80, and reel 5 is spun up by motor 66 to substantially match the peripheral velocity of winding surface 20 with the velocity of the strip advancing from casting surface 38 of chill wheel 3. During the initial spin-up, brake 72 prevents movement of take-up web 8. As a result, web 8 remains in sliding contact with quench surface 38 and winding surface 20. While the positioning of take-up web 8 against casting wheel 3 and winding reel 5 have been described with respect to a stationary casting wheel and stationary winding reel, it is readily apparent that web 8 could be positioned and held in sliding contact with casting wheel 3 and winding reel 5 after they have already been spun up to their respective, desired rotational speeds.

In the embodiment shown in FIG. 2*b*, the windage (Bernoulli effect) caused by the rotation of winding reel 5 creates a lower pressure region between the web 8 and winding surface 20. This windage provides an effective connecting means which holds and presses the end of web 8 against winding surface 20 and conforms it to the surface contour. However, the restraint of brake element 72 prevents feeding of web 8 onto winding reel 5. Instead, web 8 slides on winding surface 20, and no winding takes place.

It is readily apparent that the web can be maintained in sliding contact with winding surface 20 with various other means. For example, if the web is composed of a magnetically susceptible material (ferromagnetic foil), a magnetically attractive winding surface can be employed to hold take-up web 8 in sliding contact against reel 5.

Just before the casting operation is started, brake element 72 is released from take-up web 8 and the web is free to feed around the casting wheel onto reel 5. This action allows web 8 to wrap itself in a completed loop around winding surface 20, which in turn, grabs the web and tugs it tight in a non-slip engagement with the winder reel hub. To assist the attachment of web 8 to surface 20, additional grab mechanisms, such as releasable clamps or latches, may be employed to engage and hold the web. Alternatively, a roller may be selectively moved into contact with web 8 to urge it against surface 20 and guide it around reel 5 into a complete loop. As a result, the leading end of web 8 more readily enters into the nip region formed between surface 20 and the trailing portion of the web to become captured in a non-slip engagement.

Figure 4:
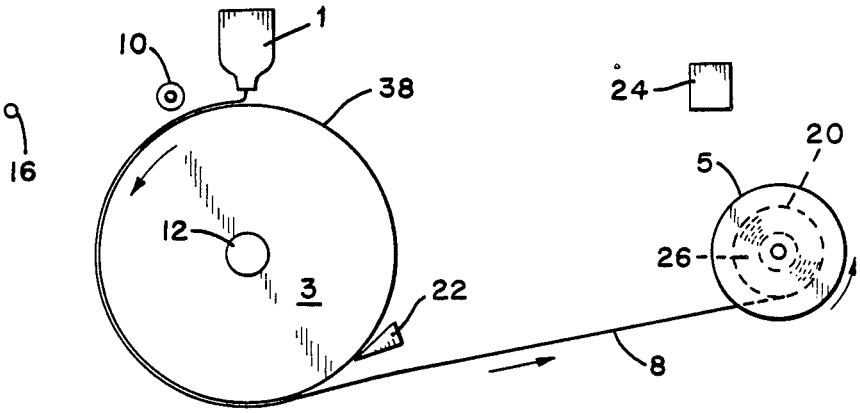
FIG. 4 shows a schematic representation of the inline winding of a cast strip after the supply of take-up web has been exhausted.

When the cast starts, strip 4 enters nip region 62 between take-up web 8 and quench surface 38, as representatively shown in FIG. 3, and becomes entrapped between the casting wheel and take-up web. This entrapment forces the cast strip to follow and conform to the rotating casting wheel surface as soon as the strip is formed. Just beyond the point of tangency of web 8 with wheel 3, where the web 8 departs from quench surface 38 to go to reel 5, strip 4 is no longer held against the wheel by the web and is free to depart from quench surface 38. A stripper means 22, such as a scraper blade or a high velocity jet of gas, can be employed to help dislodge strip 4 from casting surface 38. Strip 4 is thus moved against take-up web 8, which directs and transports the strip therewith into the nip 84 between web 8 and winding surface 20 located on the enwrapped reel hub. Once strip 4 becomes wound around on itself, it will continue to wind on reel 5 without further need of take-up web 8, as representatively shown in FIG. 4. As a result, web 4 need only be sufficiently long to initiate winding of strip 4 onto reel 5 and may be relatively short.

When the stripper means is comprised of a high velocity jet of gas, a support member 23 is located in close, adjacent relation to web 8 to minimize any fluttering of the web and cast strip caused by turbulence or vibrations.

To ensure that the velocity of web 8 around casting surface 38 is sufficiently matched to the tangential velocity of the casting surface and cast strip, a forcing means, such as a high velocity gas jet or resilient rubber pinch roller 25 mounted on pivotable arm member 27, presses web 8 into a substantially non-slip, frictional engagement with strip 4 and/or casting surface 38. This frictional engagement effectively matches the speed of web 8 to the speed of strip 4 and facilitates the desired transport onto reel 5. A suitable force mechanism 31, such as a compressed spring or pneumatic actuator, operably pivots arm member 27 to urge pinch roller 25 against web 8. The resultant tension in the portion of web 8 between casting wheel 3 and reel 5 can exert a retarding torque on reel 5 which slows the reel rotational speed to substantially match the peripheral speed of winding surface 20 to the speed of the advancing web 8 and strip 4.

A number of alternative procedures may be employed to initiate the web winding process of the invention. For example, web 8 can be threaded around a stationary, non-rotating casting wheel 3 and suitably affixed, such as by taping, to the winding surface of non-rotating reel 5. Then wheel 3 and reel 5 are spun up to speed, and pinch roller 25 is engaged to press web 8 against surface 38. When the moving components reach the desired speed, casting of strip 4 can begin. Also, drive motor 66 can be first accelerated to speed and then subsequently engaged through clutch mechanism 70 to bring reel 5 from a stationary condition up to the desired winding speed.

To ensure reliable winding of strip 4 onto reel 5 to form a uniformly wound package, the reel and the casting wheel should be carefully aligned with each other along their respective, axial directions. In addition, they should be aligned with little or no relative cant angle between the reel 5 and casting wheel 3. Such a relative cant could impart a twist to strip 4 and induce it to "walk" up one side flange of reel 5.

It may be desirable to enwrap the entire length of strip 4 with web 8. To accomplish this, a sufficient amount of take-up web 8 can be provided by take-up web supply means 18. This procedure can be employed if multiple strips are simultaneously cast on quench surface 38 and special guidance and wrapping constraints are needed during the winding process. In addition, one may desire to wind strip 4 into a coil that is interleaved with a dielectric or insulating material. For example, a Mylar take-up web may be employed to provide insulation between the faces of the as wound strip, thereby providing an insulated coil which is wound simultaneously with the casting process. This procedure can save several operations in the manufacture of an insulated coil product. A take-up web may also be employed for the entire length of the cast strip if strip 4 is too weak to support the winding tension. In such case, take-up web 8 protects the cast strip from turbulent air currents, supports the cast strip, and absorbs the winding tension exerted by reel 5.

A thermo-adhesive dielectric web 8 may also be employed to provide a carrier and substrate for the production of flexible "printed" circuit leads. Multiple narrow strips of conductive material may be cast and then adhered to web 8, attached by their residual heat and contact with the web while on casting wheel 3 and winding reel 5.

Tension on take-up web 8 and strip 4 can be provided by a slip clutch mechanism associated with reel 5 or by other suitable means, such as a synchronous hysteresis motor employed to drive the reel.

Figure 5:
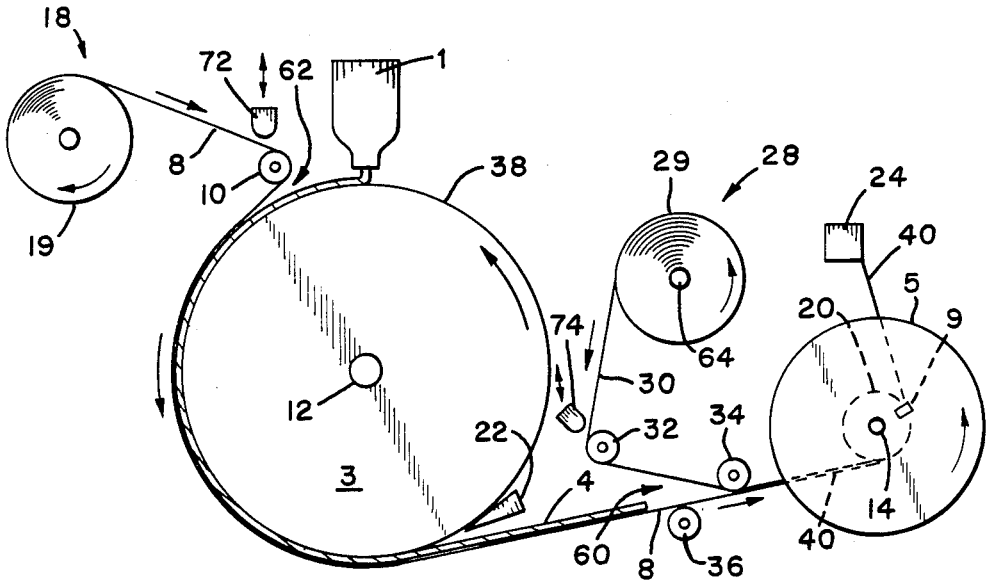
FIG. 5 shows a schematic representation of a pinch web used in addition to the take-up web.

FIG. 5 representatively shows a further aspect of the invention, which includes a pinch web 30 for capturing and entrapping strip 4 between the pinch web and take-up web 8. Pinch web supply 28 includes a roll 29 of web material which is rotatable about shaft 64. Web 30 passes around guide rollers 32 and 34, and forms a pinching nip region 60 with take-up web 8. Roller 36 guides take-up web 8 into a facing, adjacent relation to pinch web 30 and the two webs 8 and 30 are suitably held against winding reel 5 by holding means 24 for eventual connection to winding surface 20 with a suitable gripping mechanism 9. If desired, web 30 may be glued or otherwise attached to web 8 at some point on or between guide rollers 34 and winding reel 5 to form a composite web 40. Thusly arranged, webs 8 and 30 are adapted to concentrically wind onto reel 5 in a laminated configuration. Selective engagement of brake element 74 against web 30 and guide roller 32 prevents movement of web 30 until actual strip casting begins. Just prior to casting strip 4, holding mechanism 24, if employed, releases composite web 40 and gripping (connecting) mechanism 9 engages and holds the composite web against winding surface 20 of reel 5. In addition, brake elements 72 and 74 release their engagement with webs 8 and 30 respectively to allow concentric winding of the webs onto reel 5. The rotational velocity of winding reel 5 is adjusted to move take-up web 8 and pinch web 30 at a velocity which approximately matches the peripheral casting velocity of quench surface 38 and the velocity of advancing strip 4. As strip 4 is cast onto quench surface 38, it passes into nip region 62 between web 8 and quench surface 38. Web 8 holds strip 4 in hugging relation to quench surface 38. When web 8 and strip 4 separate from quench surface 38, strip 4 is directed by web 8 into web nip region 60 between take-up web 8 and pinch web 30. The two webs capture strip 4 therebetween and transport it to winding reel 5, which may be remotely located from casting wheel 3 by tens of feet or more.

Figure 6:
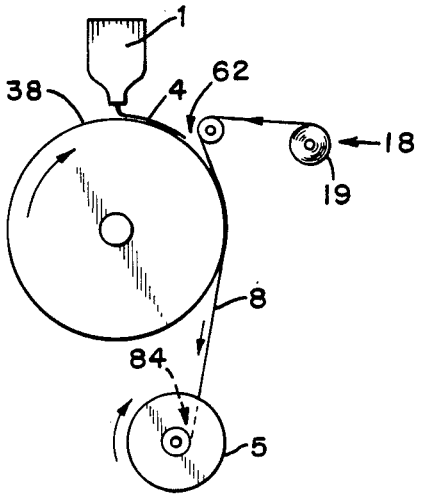
FIG. 6 shows a schematic representation of a take-up web which contacts the quench surface of a rotating chill reel for a relatively short time.

FIG. 6 representatively shows a casting apparatus employing a single take-up web 8 which makes a relatively short contact with quench surface 38.

Figure 7:
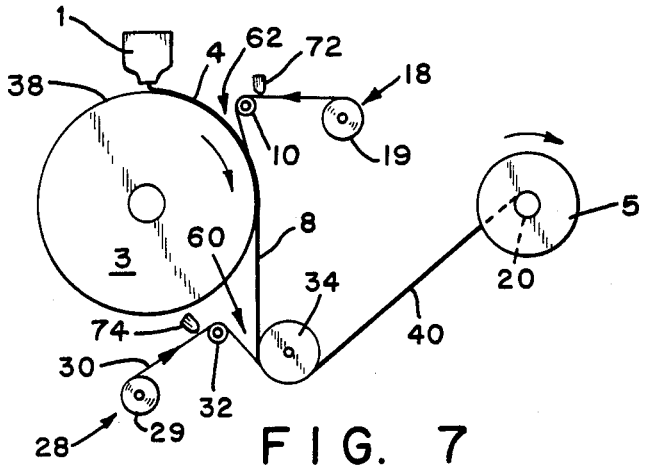
FIG. 7 shows a schematic representation of the apparatus shown in FIG. 6 which also includes a pinch web.

FIG. 7 representatively shows a pinch web employed to entrap cast strip 4 between web 30 and take-up web 8 to transport the strip to a remotely located winding reel. Guide rollers 32 and 34 are arranged to capture strip 4 in web nip region 60 at a point where take-up web 8 and pinch web 30 come into adjacent, facing contact on guide roll 34. Take-up web 8 and pinch web 30 form a composite web 40 which holds strip 4 therebetween and transports the strip for winding onto reel 5 in a concentric, laminated configuration with webs 8 and 30.

FIG. 8 representatively shows a single take-up web 8 employed in combination with an endless casting belt 42. Casting belt 42 is driven around wheels 44 and 46 with suitable drive means, such as an electric motor, and has a quench surface 54.

Figure 9:
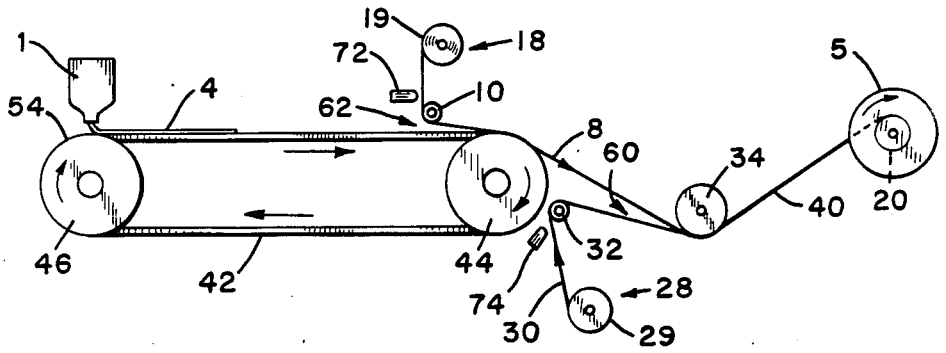
FIG. 9 shows a schematic representation of a pinch web used in association with the apparatus shown in FIG. 8.

FIG. 9 representatively shows a casting belt employed in combination with a take-up web 8 and a pinch web 30. Rollers 10 and 34 guide take-up web 8 to contact a portion of casting belt 42. Rollers 32 and 34 guide and position pinch web 30 in facing relation with take-up web 8 to form a pinch nip 60 therebetween. Webs 8 and 30 come together on guide roller 34 to form a composite web 40 configured to entrap strip 4 therebetween during casting and carry it for winding onto reel 5. Reel 5 is rotated at a suitable speed to provide a velocity of the composite web 40 that substanitally equals the velocity of strip 4 as it advances off of casting belt 42.

Figure 10:
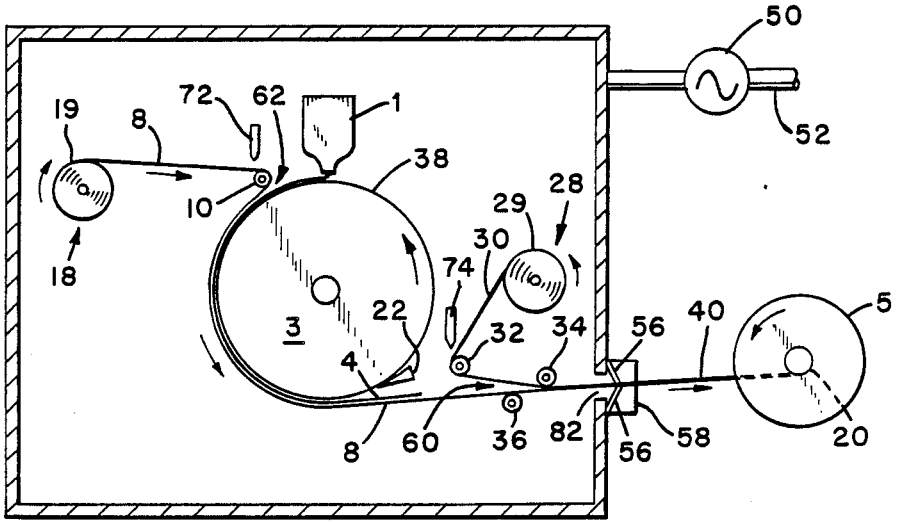
FIG. 10 shows a schematic representation of a take-up web and a pinch web employed to direct rapidly cast strip from a casting surface located within a vacuum chamber to a winding reel located in an ambient atmosphere.

As representatively shown in FIG. 10, the combination of take-up web 8 and pinch web 30 can be advantageously employed to transport cast strip from a vacuum casting chamber into the ambient atmosphere for concurrent winding. The vacuum casting of rapidly solidified metal alloys is discussed in U.S. Pat. No. 4,154,283 to R. Ray. To remove cast strip from chamber 48, the strip passes through exit opening 82. A suitable seal means comprised of side members 58 and flexible flap members 56 minimizes the intrusion of ambient atmosphere into vacuum chamber 48. Take-up web 8 is threaded from spool 19 around roller 10, around casting wheel 3 and over guide roller 36. Pinch web 30 is threaded from spool 29 over rollers 32 and 34, and is located in facing relation with take-up web 8 to form a composite web 40. Composite web 40 passes out exit 82 between sealing flaps 56 to winding reel 5. During casting, composite web 4 becomes attached to reel 5 which moves the composite web at a velocity substantially equal to the velocity of advancing strip 4. Take-up web 8 and pinch web 30 capture strip 4 in web nip region 60, and direct the strip between flaps 56 and through exit 82. The webs then transport the strip to reel 5 for winding. When web supplies 18 and 28 are exhausted, strip 4 continues to be drawn from vacuum chamber 48 through seal flaps 56. With this arrangement, strip 4 can be continuously cast in a vacuum chamber while being continuously wound in the ambient atmosphere.

Similarly, chamber 48 may be filled with a modified, atmosphere, such as an atmosphere composed of an inert gas or a reducing gas. The pressure of this selected atmosphere can be different than ambient pressure, if desired. The strip can then be rapidly cast within the modified atmosphere and efficiently removed from chamber 48 for subsequent, concurrent winding.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for casting and winding a strip of metallic material comprising:

a. means for continuously casting metallic material said means comprising a moving casting surface and means for depositing a molten metallic material thereon which rapidly solidifies to produce said strip;

b. take-up web supply means for supplying a flexible take-up web, said take-up web supply means being constructed and arranged to move said take-up web in hugging relation with said solidified strip and casting surface;

c. winding means having reel means for taking-up and concentrically winding said strip and take-up web thereof in a laminated configuration;

d. connection means for connecting said take-up web to said reel;

e. reel drive means for rotating said reel to provide a peripheral tantential velocity at a winding surface on said reel that substantially matches the velocity of said advancing strip; and f. directing means for directing said advancing strip onto said take-up web for transport to a winder nip region located at said winding surface of said reel means.

2. An apparatus as recited in claim 1, wherein said casting surface is a surface of an endless belt.

3. An apparatus as recited in claim 1, wherein said casting surface is an outer peripheral surface of a rotatable casting wheel.

4. The apparatus of claim 1 further comprising means associated with said take-up web supply means for preventing movement of said flexible take-up web relative to said moving casting surface.

5. An apparatus as recited in claim 1, further comprising a pinch web supply means for supplying a flexible pinch web which is moveable in a facing, hugging relation to said take-up web onto said reel.

6. An apparatus as recited in claim 1, further comprising a vacuum means for enclosing a casting portion of said casting surface and a portion of said take-up web supply means, and for providing a selected level of vacuum therearound; said vacuum means having an exit means for exiting said strip and take-up web from said vacuum means into an ambient atmosphere of higher pressure.

7. An apparatus as recited in claim 6, further comprising a pinch web supply for supplying a flexible pinch web which is moveable in a facing, hugging relation to said take-up web.

8. An apparatus as recited in claim 1, further comprising tensioning means for providing a selected tension on said take-up web.

9. An apparatus as recited in claim 1, wherein said take-up web includes an adhesive layer which is arranged to contact and hold said cast strip.

10. An apparatus as recited in claim 1, further comprising a forcing means for pressing said take-up web into a substantially non-slip, frictional engagement with said casting surface.

11. An apparatus as recited in claim 10, wherein said forcing means is comprised of a pinch roller urged against said take-up web.

12. An apparatus as rcited in claim 11 wherein said pinch roller is mounted on a pivotable arm member that pivots to move said pinch roller against said take-up web.

13. An apparatus as recited in claim 1, wherein said connection means is comprised of a roller which is selectively moveable into contact with said take-up web to guide the take-up web around said reel into a complete loop.

* * * * *

UNITED STATES PATENT AND TRADEMARK OFFICE

CERTIFICATE OF CORRECTION

PATENT NO. : 4,756,788

DATED : July 12, 1988

INVENTOR(S) : J.R. Bedell et al.

It is certified that error appears in the above-identified patent and that said Letters Patent is hereby corrected as shown below:

Col. 4, line 14: "guench" should read -- quench --.

Col. 6, line 13: "web 4" should read -- web 8 --.

Col. 8, line 23: "substanitally" should read -- substantially --.

Col. 9, line 19: "tantential" should read -- tangential --.

Signed and Sealed this

Twenty-sixth Day of September, 1989

*Attest:*

*Attesting Officer*

DONALD J. QUIGG

*Commissioner of Patents and Trademarks*